United States Patent [19]

Cozzens et al.

[11] Patent Number: 4,793,823

[45] Date of Patent: Dec. 27, 1988

[54] CAM LEVER CONNECTOR

[75] Inventors: Brian E. Cozzens, Mechanicsburg, Pa.; William R. Evans, Mooresville, N.C.; Wayne E. Kleiner, Mohrsville, Pa.

[73] Assignee: AMP Incorporated, Harrisburg, Pa.

[21] Appl. No.: 113,946

[22] Filed: Oct. 28, 1987

[51] Int. Cl.[4] ..... H01R 4/24

[52] U.S. Cl. ..... 439/409; 439/400; 439/372

[58] Field of Search ..... 439/389–410, 439/413, 432, 777, 789, 284, 286, 288, 372

[56] References Cited

U.S. PATENT DOCUMENTS

| | | | |
|---|---|---|---|
| 4,157,208 | 6/1979 | Roberts, et al. | 339/98 |
| 4,160,317 | 7/1979 | Sergeant | 29/749 |
| 4,173,067 | 11/1979 | Steiner, et al. | 29/749 |
| 4,341,430 | 7/1982 | Crawford | 339/99 R |
| 4,455,058 | 6/1984 | Harner et al. | 439/409 |
| 4,536,049 | 8/1985 | Wilmes | 439/409 |
| 4,637,675 | 1/1987 | Loose | 339/97 R |
| 4,645,285 | 2/1987 | Cozzens, et al. | 339/96 |
| 4,729,738 | 3/1988 | Heng et al. | 439/409 |

FOREIGN PATENT DOCUMENTS

| | | | |
|---|---|---|---|
| 0099008 | 1/1984 | European Pat. Off. | 439/409 |
| 2158303 | 11/1985 | United Kingdom | 439/395 |

OTHER PUBLICATIONS

"Amp Tel-Splice Connectors" Data Sheet 77-455 Rev. 9-83-Amp, Incorporated.

Drawings-Ser. No. 100,378 filed 9/24/87.

*Primary Examiner*—David Pirlot

[57] ABSTRACT

An electrical connector (10) terminates a conductor wire (70) through a terminal (50) having a curved slot (54), the terminal being mounted in a housing (12) which is made to contain a cam lever (30) having cam slots (42), the cam lever being mountd for rotary movement so that the cam slots force a conductor wire into the terminal slot through a mechanical advantage allowing larger gauge wires to be terminated in a tooless manner.

5 Claims, 4 Drawing Sheets

CAM LEVER CONNECTOR

This invention relates to an electrical connector for terminating electrical conductor wires by forcing a conductor wire into an insulation displacement, split beam metal terminal through a cam lever mechanism.

BACKGROUND OF THE INVENTION

In U.S. Pat. No. 4,645,285 to B. E. Cozzens et al., issued Feb. 24, 1987 and entitled "Sealed Insulation Displacement Connector", a type of insulation displacement connector (IDC) is disclosed wherein conductor wires are forced into an IDC terminal through the use of an elastomeric body which seals the connection and at the same time provides the pushing force to drive the conductor wire into the terminal slot. The arrangement there shown uses a push button like structure to effect termination of conductor wires to a printed circuit board which is part of an electronic package. The connector of this prior patent is particularly directed to terminating the smaller gauge wires, on the order of 18 through 28 AWG, the bulk of which are used to carry signal energy as contrasted to the heavier wires which may be employed to carry power to and from electronic devices or power supplies. The term "larger gauge wires" may be taken to mean wires from 8 to 24 gauge, there being an overlap in the smaller gauges with respect to use for both power and signal.

When terminating the smaller gauge wires in IDC devices, the forces required to strip and deform the wires inserted in slots of terminals are sufficiently low to be done manually by an operator without a tool, such forces being under 20 pounds and requiring a displacement of under a hundred thousandths of an inch to effect termination.

With respect to termination of larger gauge wires utilizing IDC techniques, the forces for termination may exceed 30 pounds and indeed extend into the range of 50 or 100 pounds, making repeated termination by an operator difficult or at least more difficult than with respect to the smaller gauge wire.

Additionally, it has been found to be important that with any IDC termination which is essentially tooless and therefore lacks the precision possible with a terminating tool to provide a very clear-cut and positive indication for the user operator, that termination has been in fact accomplished. Put another way, the pushing of a button like structure through a limited displacement, on the order of a tenth of an inch or so may not provide either the tactile or visible indication necessary for reliable use with operators of varying experience and skills.

SUMMARY OF THE INVENTION

Accordingly, it is an object of the present invention to provide a tooless IDC type termination having a mechanical advantage built in to a connector so as to be useful with wire gauges having termination forces making simple linear manual actuation difficult. It is a further object of the invention to provide a connector wherein the actuation to terminate a wire is both visibly and tactilely recognizable and which lends itself to easy examination in terms of whether the wire is terminated or not.

The invention achieves the foregoing objectives and attempts to solve problems with prior approaches by providing an IDC slotted terminal having a slot which is curved rather than straight in conjunction with a plastic molded housing containing a molded cam lever including an actuating arm and slots curved to drive a conductor wire in an arcuate fashion in the curved slot of the terminal upon rotation of the cam member. The cam member includes an extendable lever to enhance mechanical advantage as applied to driving or forcing the wire in the slot of the terminal. In an alternative fashion, the cam lever is provided with a recessed molded-in slot, allowing tool such as a screwdriver to be inserted to further enhance mechanical advantage in the actuation of the cam lever to effect termination. A connectorized multiwire version of the invention is also disclose wherein multiple cam units are actuatable to terminate multiple wires.

DETAILED DESCRIPTION OF THE INVENTION

Figure 1:
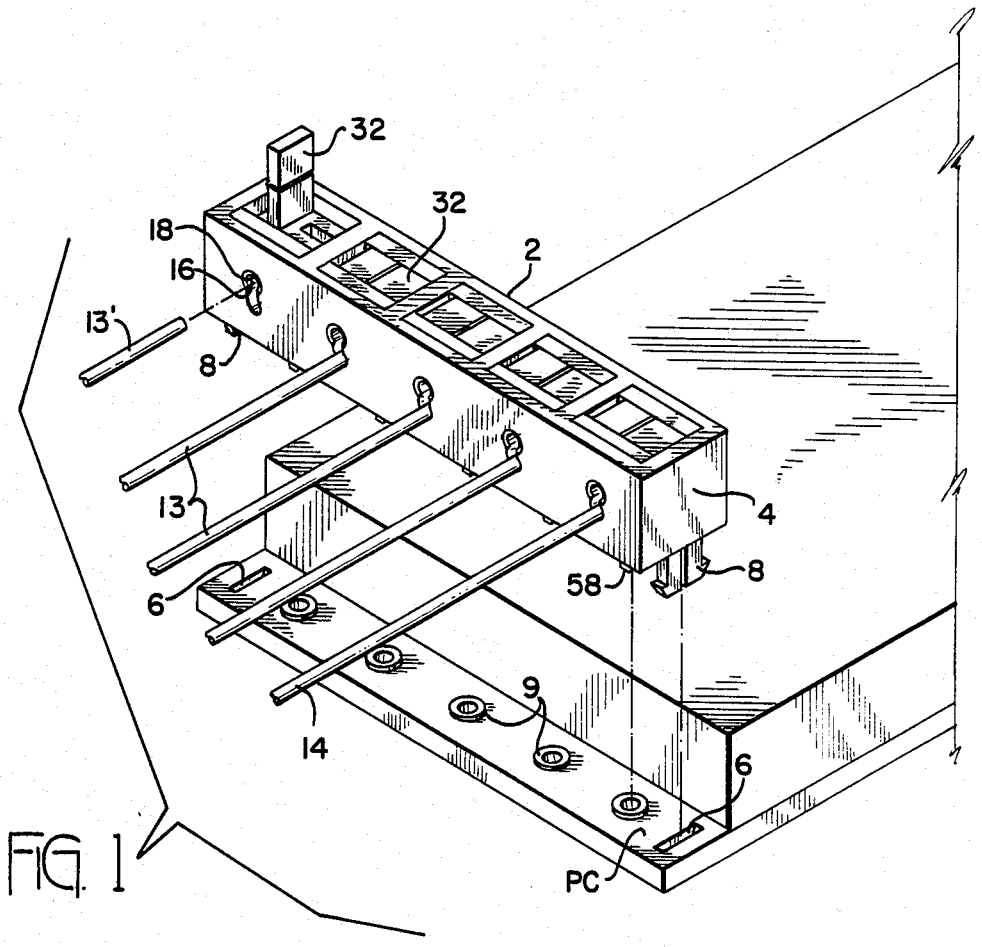
FIG. 1 is a perspective showing a connector in accordance with the invention in conjunction with an electronic module into which the connector is plugged; the connector being shown actuated to terminate all but one of the wires served thereby.

Referring now to FIG. 1, the present invention is depicted in a connector embodiment for terminating five signal conductor wires; the connector shown as 2 including a housing 4 with four of the conductor wires shown as 13 being terminated and one of the connector wires shown as 13' prior to termination. Each of the wires 13,13' includes a conductor core 14 and an insulating jacket 15. The connector 2 is shown poised prior to interconnection with an electronic package (EP) which may be taken to be a functional device for communication, computers, modems, multiplexers and the like. The unit EP includes at one end the exposed surface of a printed circuit board shown as PC relieved as by an aperture 6 at each end to receive the insertion of a fastener portion 8 of the connector 2 and a series of spring contact elements shown as 9 which receive post or tab terminals 58 extending from the connector. As can be discerned from FIG. 1, the left-hand portion of the connector is undetermined, having a cam lever shown as 32' in the upward or vertical position and the wire 13' associated therewith positioned prior to insertion in an aperture shown in FIG. 1 as 16 in the connector sidewall. The aperture 16 is surrounded by a bevel or funnel entry surface shown as 18 to assist in wire insertion within the connector. The remaining four cam levers shown as 32 are indicated as actuated in the view shown in FIG. 1. This feature reveals at a glance the status of the connector relative to terminated or unterminated positions and wires by virtue of the position of the cam levers 32 which are typically molded in colored plastic which contrasts with the plastic of the molded housing 4. It is contemplated that the different levers 32 may be molded in different colors associated with the colors of the wires 13 and 13' as an aid to system wiring in premise applications where various wiring harnesses are hooked up to various electrical and electronic devices which form part of the power and signal and ground circuits in a building or facility or vehicle.

In brief summary then, the invention contemplates a device in a connector or other forms wherein wires may be terminated by being inserted into a connector housing and thereafter driven into engagement with an IDC terminal in a manner to be hereinafter disclosed through the actuation of a cam lever, the connector thereafter being plugged into a suitable contact spring receptacle mounted in the device being served thereby It is of course contemplated that such a connector may be disconnected at a subsequent time for removal or replacement or upgrade of the electronic device served thereby, or, occasionally for changes in the wiring system.

As can be discerned from FIGS. 4–7, an alternative of the invention either in a single or in a multiple wire connector, embraces the concept of the conductive terminal portion of the connector being permanently attached to the circuit such as a printed circuit board as by soldering as an alternative to being plugged into a spring contact element, itself being soldered to the circuit board. The invention contemplates a choice of either the pluggable or the more permanent solder type termination, dictated essentially by whether or not the wire harness is applied in the factory or in the field.

Figure 2:
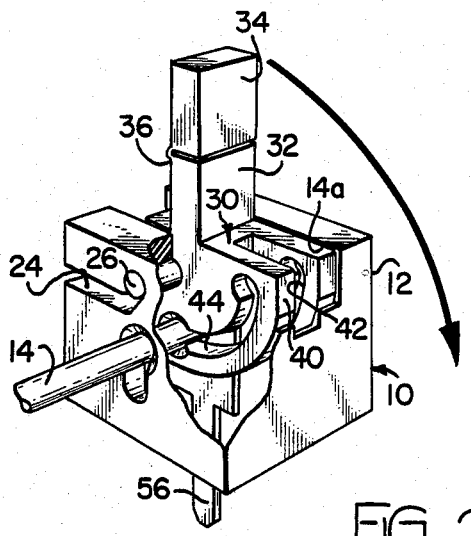
FIG. 2 is a perspective of a single connector in accordance with one embodiment of the invention, partially sectioned and in a pre-actuation position.

FIGS. 2–5 show the invention connector 10 in a single wire form to include a housing 12 suitably molded of an engineering plastic material having insulating and dielectric qualities, various derivatives of nylon or the like being quite suitable.. The housing 12 includes an interior recessed area 14A as shown in FIG. 2 extending downwardly from the top of the housing and opening in the top portions on the sides of the housing 12. In the front of the housing there is included an aperture 16 surrounded by a beveled and funnel shaped surface 18 which assists in wire insertion. Interiorly of the recess 14A are surfaces indicated as 20 in FIGS. 4 and 5 which accommodate the placement of a terminal 50 which includes a post portion 56 extended through an aperture 22 in housing 12. Also in the front face of housing 12 is a slot shown as 24 which terminates in a rounded aperture 26 intended to accommodate the molded cam axle of the cam lever structure shown as 30 in FIGS. 2–5. The slot 24 is utilized to allow initial assembly of the cam lever 30 into housing 12 and the aperture 26 is intended to retain the cam lever in position and allow rotary actuation thereof. There is a slot and aperture equivalent to elements shown as 24 and 26 in the sidewall the housing 12 opposite to that shown in FIGS. 2–5. These surfaces of housing 12 accommodate a further extension of the molded axle of cam lever 30.

In the embodiment of the invention connector shown in FIGS. 2–5, the cam lever 30 is made to have an extension 32 forming the lever and a projection 34 interconnected by a flexible hinge portion 36 which effectively increases the length of the structure forming the lever by 30 percent, thus extending the mechanical advantage obtained thereby significantly. Such plastic hinges are frequently referred to as "polyhinges" and are well known in the plastics industry, essentially formed in a variety of thermoplastic materials including certain nylons, polypropylene and polyethylene. As can be discerned in FIGS. 4 and 5, the hingeable extension element 34 can, after use, be folded in a manner so that it does not extend beyond the outer surfaces of the housing 12 and makes for a more compact and better appearing connector package. This leverage enhancing feature is, it will be recognized, only one possible embodiment, the lever 32 shown in FIG. 1 can also be solid without the extension 36 and the lever shown in FIGS. 6 and 7 being yet alternative embodiment to achieve enhancement of mechanical advantage. In general, the necessary advantage is dependent upon wire size, the larger the wire gauge the more force required. The smaller gauge wires such as those in the range of 18 to 28 AWG may generally be done with a short cam lever requiring only modest mechanical advantage if any at all, with the wire sizes larger than 18 AWG calling for more advantage and the alternative embodiments which provide such advantage as shown in this disclosure.

Figure 3:
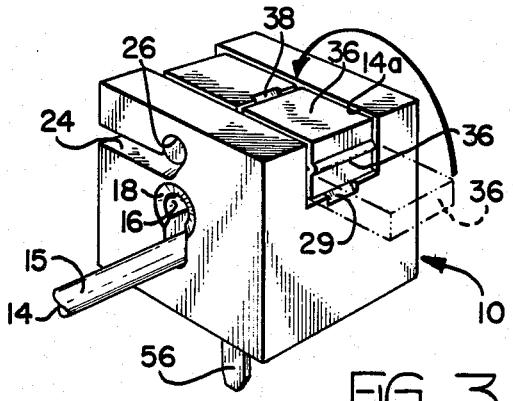
FIG. 3 is a view of the connector of FIG. 2, not sectioned but in a condition following actuation to terminate a conductor wire.

The cam lever structure 30 includes a relieved surface 38 as shown in FIG. 3 proximate the rear upper surface of the lever portion 32 which serves to facilitate removal of the flexible end portion 34 following its being folded in to the position shown in FIG. 3. There is a similar relieved surface shown as 29 in FIGS. 2 and 3 to allow the cam lever to picked up for rotation for opening and wire removal. Both of these small surfaces may be accessed by the end of a small blade such as a screwdriver or the like. Cam 30 may be seen in FIG. 2 to include a projecting yoke portion 40 which is slotted throughout the lower portion of 30 as at 42, the width of the slot 42 being dimensioned to be slightly wider than the thickness of the blade terminal 50 so as to facilitate movement of the blade up within 42 during actuation of the device.

Figure 4:
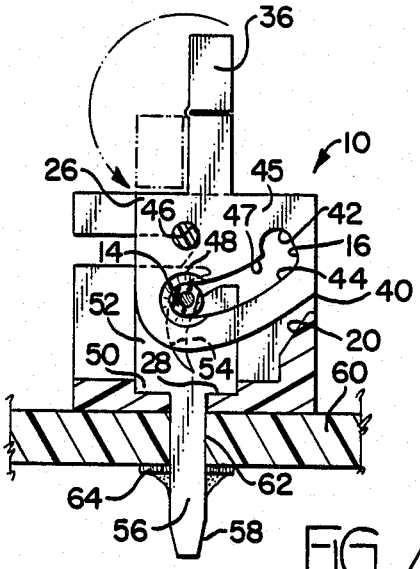
FIG. 4 is an elevation of the connector as shown in FIG. 2, partially sectioned and terminated to a printed circuit board.
Figure 5:
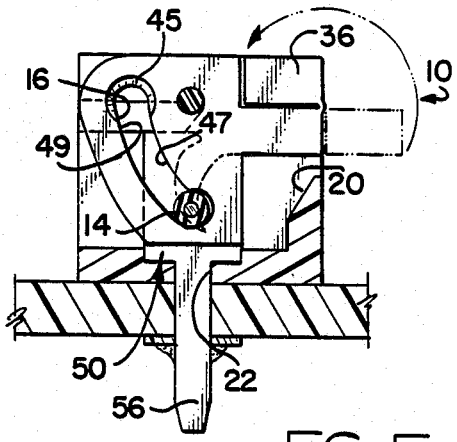
FIG. 5 is a view of the connector of FIG. 4 in an actuated position.

The yoke portion 40 includes further in each of the walls thereof a slot, arcuate in shape, the slot being shown as 44 in FIGS. 2 and 4 and 5. The slots both contain beveled portions 45 as best seen in FIGS. 4 and 5 with respect to the near slotted portion. These beveled surfaces facilitate insertion of a conductor wire within the device, tending to funnel the wire for insertion to a fully seated position. The slots 44 are of a width to provide an upper bearing surface 47 which cams a wire downwardly and into the soot of the terminal upon rotation of the cam lever. The opposite or bottom surface 49 of 44 serves the reverse function by camming the wire upwardly and out of the slot upon a reverse rotation of the cam lever. FIG. 4 shows a wire as initially positioned within the connector device and prior to actuation of the cam lever. FIG. 5 shows the wire fully positioned within the slot of the terminal following actuation of the cam lever 30. To remove a wire from the device, the cam lever is rotated in a reverse sense, or back to the position shown in FIG. 4 where upon the lower surface 49 of 44 cams the wire out of the slot and frees it for removal from the device.

The terminal 50 may be seen in FIGS. 4 and 5 to include an upper blade portion 52 made to contain an arcuate slot 54, the arc of which is made to be compatible with the arc and direction of the force generated by the slot 44 of the yoke 40. The lower portion of the terminal slot 54 is dimensioned in accordance with IDC practice to be between 40 percent and 80 percent of the conductor of the wire. The terminal 50 further includes extending from the blade portion 52 a tab or post portion shown as 56 tapered at the end as at 58 for insertion into and through a printed circuit board 60 via an aperture shown as 62 to be permanently joined to a copper trace 64 on the lower board surface by being soldered thereto. The terminal 50 is typically made of an alloy of copper such as brass, phosbronze or the like having spring characteristics and being of a hardness or temper suitable to define an inelastic spring holding the slot surfaces tightly against the conductor surfaces of the conductor wire as forced into the slot of the terminal. This is in accordance with well-known IDC principles. Also in accordance with such principles the slot 54 is given a length to facilitate a wiping of the conductor wire as it is being displaced therealong, such movement being at least on the order of 1½ times the diameter of the conductor wire.

As thus disclosed then, a conductor wire 13 or 14 is inserted through the various portions of the device including the aperture 16 being guided by the funnel surface 18 through the cam lever yoke structure, the slots 44 as guided by funnel surfaces 47,49, crossing over the terminal 50 through the widened slot portion thereof to end against the inner wall of recess 14A of housing 12. In accordance with IDC principles, a permanent and gas type electrical interconnection is thereby made between the conductor wire 13 or 14 and the terminal 50, thus connecting the wire through the terminal post portion 56 to the conductive trace 64 in printed circuit board 60. Removal of the wire is achieved by a reverse of the above procedure. As a general rule, reuse of the wire is to be avoided although if the wire is a solid wire and preferably tin plated, the previously deformed end may be snipped off with a fresh portion of the same wire reinserted into the terminal and reused for at least a half dozen times without unacceptable deterioration of the electrical interface. It is recommended that reuse be engaged only in circumstances where damage to a wire or replacement of a wire make such necessary, the invention embodiment shown in FIG. 1 being preferred wherein reuse or plugging or unplugging is anticipated.

Figure 6:
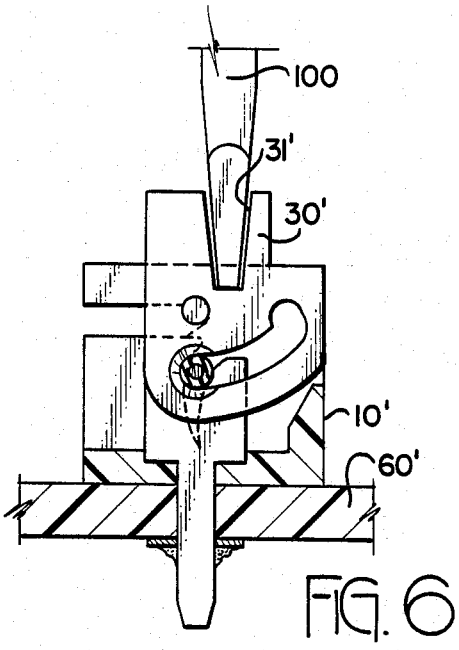
FIG. 6 is a partial elevation partially sectioned of an alternative embodiment of the connector of the invention in a condition prior to termination and actuation.
Figure 7:
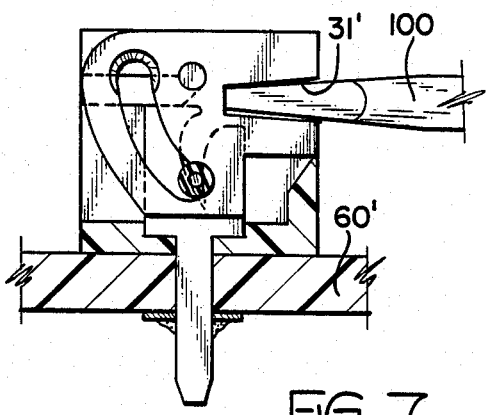
FIG. 7 is a view of the connector of FIG. 6 following actuation and termination.

Turning now to an alternative embodiment and referring to FIGS. 6 and 7, the invention there shown is essentially identical to the connector as described in FIGS. 4 and 5 with the exception as indicated by the modification to the cam lever. This modification is shown as 30' to include a slot 31' in the upper portion of the cam lever. The slot 31' is dimensioned to receive insertion of a tool, the tip of which is shown as 100 which may be taken to be the end of a standard screwdriver blade or the like. The screwdriver may have a length of a several inches or more to thus provide an enhanced leverage and mechanical advantage to the device in terms of camming a wire into a slot of a terminal. In general, the embodiment shown in versions revealed in FIGS. 6 and 7 is preferred for the larger sized range of wires where more force than is readily available from shorter levers or lesser mechanical advantage obtained. FIG. 6 shows the connector 10' in an open condition of actuation with a wire inserted therein and FIG. 7 shows the mechanism following actuation with the wire cammed downwardly into the slots of the terminal as shown as 50'. The invention embodiment as shown as revealed in FIGS. 6 and 7 contemplates a variety of shapes for surface 31 including the shape of a well known wrench or a square rod rather than the blade shape shown in order to limit ability to actuate the device.

A further alternative variation not shown but here disclosed embraces the removal of the lower portion of yoke 42, eliminating the lower surface 44 of what was a slot as defined and shown in the previous figures. This removal will preclude removal of the wire by reverse rotation of the cam lever precluding effective reuse of the connector device for reasons of wire limitation or security or the like.

Having now described and disclosed the invention intending to present preferred and illustrative embodiments thereof, we set forth the appended claims in an effort to define our invention:

We claim:

1. An electrical terminating device adapted to provide an electrical interconnection between a conductor wire and an electrical or electronic circuit comprising in combination;

a plastic insulating housing apertured to receive a conductor wire inserted therein, said housing further including an internal recess, a plastic and insulating cam lever means fitted within said recess including an engagement with said housing providing for rotary movement of said cam lever means between a first position and a second position, said cam lever means including surfaces disposed to contact said wire as said wire is inserted within said housing, and to drive said wire in movement upon rotation of said cam lever means from said first position to said second position, an electrical terminal contained within said housing extending within said recess including a slot therein dimensioned to receive said wire and upon said movement, deforming inelastically said wire and stripping insulation therefrom and effecting an electrical interconnecting with surfaces of said wire upon rotation of said cam lever means, and said cam lever means includes a portion foldable into a position to provide an enhanced mechanical advantage to the rotation thereof, said portion being connected to said cam lever means via an integral hinge.

2. The device of claim 1 wherein said cam lever means includes a further surface integral therewith and positioned to drive said wire in a reverse movement as said cam lever means is rotated from said second position to said first position whereby to facilitate removal of said wire from said device.

3. The device of claim 1 wherein the surfaces of said cam lever means are defined by an arcuate slot therein.

4. The device of claim 1 wherein said cam lever means includes an extendable portion connected to the foldable portion to provide an improved mechanical advantage relative to rotation of said cam lever means.

5. The device of claim 1 wherein said cam lever means includes a relieved surface adapted to receive a tool to provide an enhanced mechanical advantage for rotation of said cam lever means.

* * * * *